US005555554A

United States Patent [19]

Hofer et al.

[11] Patent Number: 5,555,554

[45] Date of Patent: Sep. 10, 1996

[54] VENTED HEADSET SPEAKER

[75] Inventors: Alan Hofer, Wantagh, N.Y.; Walter O. Stanton, Palm Beach Gardens, Fla.

[73] Assignee: Stanton Magnetics, Inc., Plainview, N.Y.

[21] Appl. No.: 488,796

[22] Filed: Jun. 8, 1995

[51] Int. Cl.[6] ..... H04R 25/00

[52] U.S. Cl. ..... 381/183; 381/187

[58] Field of Search ..... 381/183, 187, 381/188, 205, 25; 379/430, 431; 181/129

[56] References Cited

U.S. PATENT DOCUMENTS 4,027,116 5/1977 Nakamura ..... 381/187

FOREIGN PATENT DOCUMENTS 002676576 11/1992 France ..... 381/183

*Primary Examiner*—Curtis Kuntz
*Assistant Examiner*—Sinh Tran
*Attorney, Agent, or Firm*—Kane, Dalsimer, Sullivan, Kurucz, Levy, Eisele and Richard, LLP

[57] ABSTRACT

A headset speaker is provided in which a driver is provided in the dome of a speaker earcup and the dome has at least one vent aperture. The vent hole is closed by a movable closure having a corresponding opening therein that permits the size of the opening into the dome to be logarithmically varied between a fully open and fully closed position. A Thuras tube tuned to enhance bass frequencies is provided extending between the driver side and rear of the earcup. An opening to the Thuras tube remains fully closed by the movable closure unless the cup vent aperture is fully closed at which time the Thuras tube is opened.

9 Claims, 2 Drawing Sheets

VENTED HEADSET SPEAKER

BACKGROUND OF THE INVENTION

The present invention relates to a headset speaker and in particular to a tunable, vented speaker.

For various reason, it may desirable for a listener to have the ability to tune a headset through which he is listening. For example, a person with a hearing loss at a particular frequency would seek to tune the headset to frequencies where his hearing is best. Similarly, when a disk jockey for a dancing audience seeks to cue a new selection to a playing piece, he must precisely match the beat of the new selection to that of the playing music in order to maintain the rhythm to permit continuous dancing. To so this, the disc jockey would seek to emphasize the bass on his headset to best hear the beat of the music being cued in so that he can match it to the music being played to the audience. In other situations a listener might seek to tune out or tune in specific frequencies that contain ambient noise or desired audio information.

In view of the above, it is the principle object of the present invention to provide a tunable headset that gives the listener, within a relatively broad frequency band, the ability to tune the head set to a desired frequency range.

A further object is to provide such a headset which is extremely reliable and relatively easy to manufacture and assemble.

SUMMARY OF THE INVENTION

The above and other objects and advantages are attained in accordance with the present invention by providing a headset speaker in which the speaker driver is provided in a dome in the speaker earcup. The dome has at least one vent aperture. The vent aperture can be variably closed by a movable cover having a corresponding opening therein that permits the size of the aperture to be logarithmically varied between a fully open and fully closed position. A Thuras tube tuned to enhance bass frequencies is provided in the earcup extending between the driver side and rear of the dome. An opening to the Thuras tube remains fully closed by the movable cover unless the cup vent aperture is fully closed at which time the Thuras tube is opened.

DETAILED DESCRIPTION OF THE PREFERRED EMBODIMENT

Figure 1:
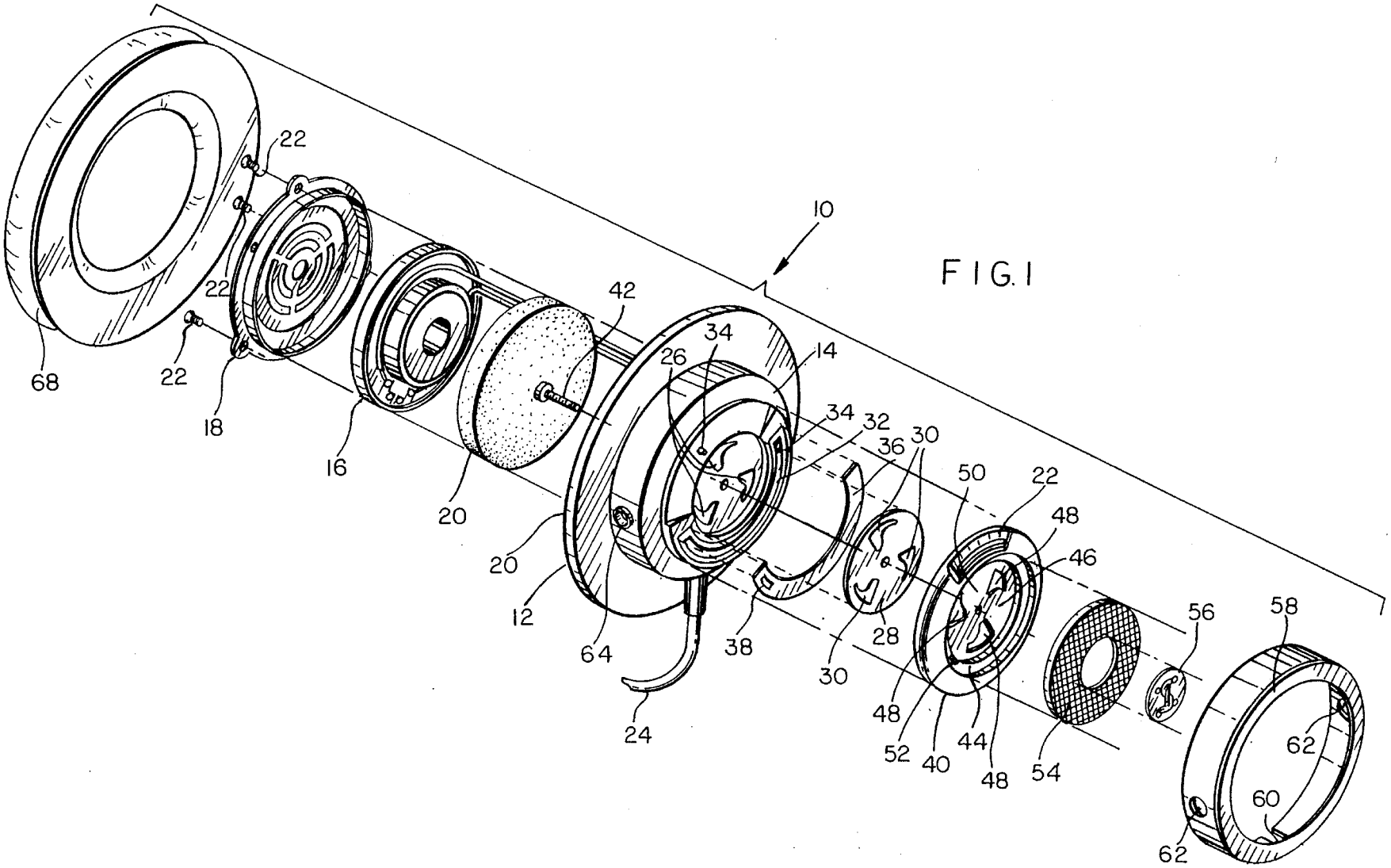
FIG. 1 is an exploded view of a headset speaker in accordance with the present invention.

Reference is now made to FIG. 1 wherein a headset 10 in accordance with the present invention is depicted in exploded view as comprising an earcup 12 having a central domed portion 14. A magnetic driver 16 covered by a baffle 18 fits in the cavity covered by dome 14 against a foam damper 20. The baffle is secured to the earcup by screws 22, thereby securing the driver and damper in position. A cable 24 extends through the earcup delivering the signal to excite driver 16 to produce an output sound. It should be appreciated that the driver, per se, is conventional and plays no part in the present invention.

The top of dome 14 is provided with three apertures 26. The apertures are disposed along a common circle and configured so that the area defined by each aperture opening increases in size logarithimically along the circle. A cork seal 28 with apertures 30 aligned with apertures 26 of the dome is adhesively secured to the back of the dome.

A groove 32 is formed about the periphery of the dome 14. An opening 34 is provided at one end of the groove extending into the interior of the dome. The groove is covered by a cork seal 36 having an opening 38 at the end opposite to opening 34. The length of the groove measured between openings 34 and 38 is chosen so as to provided a Thuras tube extending between the front (driver side) and rear of the dome tuned to between 600 and 800 Hz which vents the rear of the speaker to boost the bass response.

A rotatable closure 40 is mounted over the dome and secured to the earcup for rotation by screw 42 that extends through the dome from the front side. The closure 40 includes a peripheral rim 44 that fits over the groove 32 and a center portion 46 that includes three apertures 48 that correspond to apertures 16. It should be noted that the spacing between apertures 48 is such that each of the apertures 16 can be fully covered by the material 50 between adjacent apertures 48 of the closure. The cork seal 28 provides a relatively air-tight seal between the dome and the closure 40 while permitting the closure to freely rotate about screw 42. An opening 52 is provided in rim 44 positioned to align with opening 38 of seal 36 when the apertures 26 are covered by the material 50 of closure 40. In this manner the Thuras tube is open only when the vent holes 26 are fully closed. At other times (i.e. when the vent holes are fully or partially open), the Thuras tube is closed.

A vent screen 54 is provided over the center portion of the closure 40. A label 56 covers the center of the screen. A decorative ring 58 is provided to surround the earcup dome 14. A slit 60 is provided in the ring to accommodate the cable 24 to permit connection to driver 16. A pair of holes 62 in the ring 58 align with holes 64 in the earcup to accommodate the pivotal supports (not shown) for the headphone. A cushion 68 is provided about the base 70 of the earcup. An indicator 72 is provided on the closure. The indictor includes a slot through which a pin 74 extends. By noting the location of the pin on the indictor, the user can repeatedly go back to a setting of the apertures that he finds most comfortable. The slot may be formed with a series of indentations along its length into which the pin rides to give the user a positive feel as the closure is rotated between positions.

Figure 2:
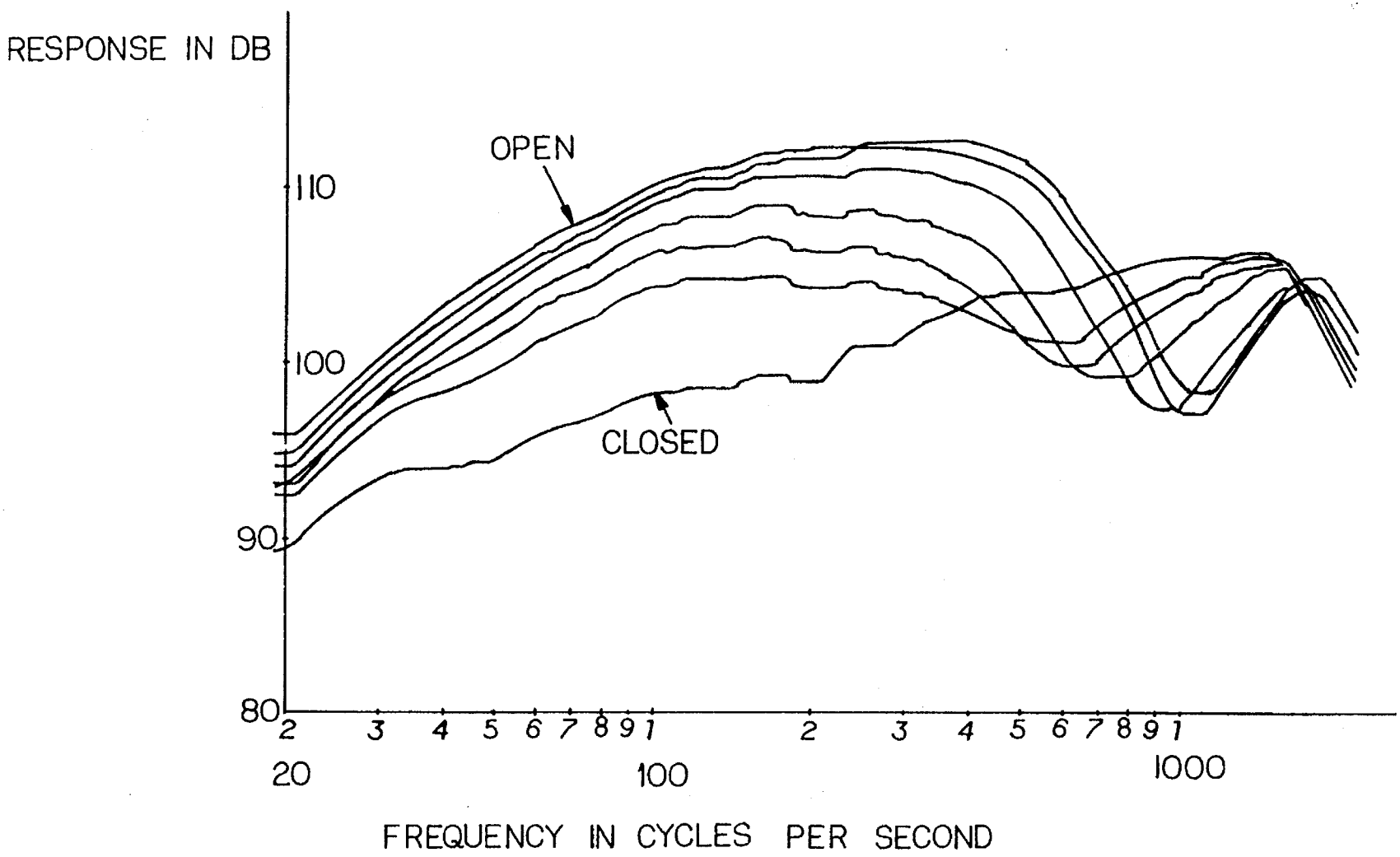
FIG. 2 is a series of curves depicting the frequency response of the headset of FIG. 1 for the venting apertures varying between fully open and fully closed positions.

Reference is now made to FIG. 2 wherein a series of curves are depicted. The top most curve shows the frequency response for the apertures fully open. As will be noted, as the apertures are increasingly closed, the bass response becomes emphasized. When the apertures are fully closed, the Thuras tube opens substantially boosting the bass response.

Thus, in accordance with the above, the aforementioned objectives are effectively attained.

Having thus described the invention, what is claimed is:

1. A headset speaker comprising:

a domed earcup;

a driver positioned within said dome;

at least one aperture extending through said dome;

a rotatable closure for said at least one aperture affixed to said dome and rotatable relative to said dome wherein rotation of said closure varies an exposed portion of said at least one aperture, between a fully open and a fully closed position;

an elongated groove formed in said dome, said groove terminating at one end in an opening extending through said dome; and a cover for said groove, said cover having an opening therein at an end of said groove opposite to said groove opening wherein said groove and said cover define a Thuras tube between said openings extending through the dome.

2. The headset speaker in accordance with claim 1 wherein said closure includes a portion to close said cover opening, wherein when said at least one aperture is fully closed, said Thuras tube is opened.

3. The headset speaker in accordance with claim 2 wherein said closure includes at least one aperture therein, said at least one aperture in said closure and said at least one aperture in said dome being shaped so as to provide a logarithmically expanding opening into said dome upon rotation of said closure relative to said dome.

4. The headset speaker in accordance with claim 3, wherein said at least one aperture in said dome includes three apertures and said at least one aperture in said closure includes three corresponding apertures, said closure apertures and said dome apertures being shaped so as to provide three logarithmically expanding openings into said dome upon rotation of said closure relative to said dome.

5. The headset speaker in accordance with claim 4 wherein said three apertures in said dome are spaced along a common circle, said closure apertures are spaced along a common circle, and the spacing between adjacent closure apertures provides sufficient material to fully close said dome apertures.

6. The headset speaker in accordance with claim 1 further comprising a damper interposed between said driver and said dome.

7. The headset speaker in accordance with claim 6 further comprising a baffle positioned against said driver opposite to said damper.

8. The headset speaker in accordance with claim 1 further comprising an ear cushion disposed about said earcup.

9. The headset speaker in accordance with claim 1 wherein said Thuras tube is tuned to between 600 and 800 Hz.

* * * * *